US006006812A

United States Patent [19]

Corey

[11] Patent Number: 6,006,812

[45] Date of Patent: Dec. 28, 1999

[54] SHEER SUPPORT WINDOW COVERING

[75] Inventor: John A. Corey, Melrose, N.Y.

[73] Assignee: Comfortex Corporation, Watervliet, N.Y.

[21] Appl. No.: 09/040,041

[22] Filed: Mar. 17, 1998

[51] Int. Cl.[6] ..... A47H 5/00

[52] U.S. Cl. ..... 160/84.05; 160/176.1 R

[58] Field of Search ..... 160/166.1 R, 84.01, 160/84.04, 84.05, 84.08, 115, 176.1 R, 178.3 R

[56] References Cited

U.S. PATENT DOCUMENTS

| | | | |
|---|---|---|---|
| 2,672,088 | 3/1954 | Orr . | |
| 2,757,727 | 8/1956 | Findell . | |
| 2,884,005 | 4/1959 | Honerkamp et al. . | |
| 3,011,518 | 12/1961 | Day et al. . | |
| 3,329,163 | 7/1967 | Barker et al. . | |
| 4,884,612 | 12/1989 | Schnebley et al. . | |
| 4,984,617 | 1/1991 | Corey . | |
| 5,165,459 | 11/1992 | Gaber et al. . | |
| 5,193,601 | 3/1993 | Corey . | |
| 5,232,037 | 8/1993 | Fraser | 160/176.1 R |
| 5,339,882 | 8/1994 | Judkins . | |
| 5,445,204 | 8/1995 | Van Der Weilen | 160/84.04 |
| 5,454,414 | 10/1995 | Colson et al. . | |
| 5,680,891 | 10/1997 | Prince | 160/176.1 R |
| 5,733,632 | 3/1998 | Marusak . | |

*Primary Examiner*—Blair M. Johnson
*Attorney, Agent, or Firm*—Rader, Fishman & Grauer PLLC

[57] ABSTRACT

A window covering includes a plurality of wide strips arranged parallel to one another in a common plane. The plurality of strips are divided into a first set of strips and a second set of strips, wherein the first set of strips are moveable in a direction opposite to the second set of strips. A plurality of panels are transversely attached to the plurality of strips, and more specifically, the upper edges of the panels are attached to the first set of strips and the lower edges of the panels are attached to the second set of strips. Upon longitudinally moving at least one of the plurality of strips from a first position to a second position, each of the plurality of panels can be altered from a first cross-sectional configuration to a second cross-sectional configuration. By altering the panels in the manner, the window treatment can provide adjustable light-control, modulatable view-through, light diffusion, all in an aesthetically pleasing presentation.

15 Claims, 4 Drawing Sheets

SHEER SUPPORT WINDOW COVERING

BACKGROUND

1. Technical Field

The present invention generally relates to window coverings and treatments. More particularly, the present invention relates to window coverings and treatments which provide the combined functional advantages of a multi-cellular window shade and a venetian blind.

2. Background Information

Today there are a significant number of attractive window coverings and treatments available to the consumer. At one time, however, the offerings were limited to traditional window is coverings, i.e., curtains, draperies, shades and venetian blinds. While the traditional offerings are still prevalent, many newer designs offer greater functional value and aesthetic quality. Indeed, the functional limitations associated with traditional window coverings has led to the design of new and unique alternative window coverings.

For instance, a weakness associated with traditional venetian blinds is their poor insulation value. Also, the unsightly vertically displaced control cords of traditional venetian blinds negatively influence their aesthetic presentation. Yet, an advantage of traditional venetian blinds is their variable view-through and light control capability.

Partly in response to the limitations inherent in the structures associated with traditional conventional window coverings like venetian blinds, fresh window coverings and treatments, such as multi-cellular window shades, were developed and welcomed by consumers. In the broad sense, a cellular window shade is a pleated window covering having a plurality of cells arranged adjacent to one another. The adjacent cells are bonded at their edges to form a complete sheet for the window covering. These multi-cellular window shades provide significant insulating value, uniform light diffusion and a desirable, pleated aesthetic presentation, but they typically have no view-through capability. Unlike traditional venetian blinds, which provide easy modulatable view-through and light control by simply adjusting the orientation of the horizontally disposed slats or vanes, traditional multi-cellular window shades are not capable of separating the plurality of cells for providing the variable view-through option. Therefore, in order for a person to see through a window which is outfitted with a traditional multi-cellular window shade, it is necessary to collectively raise and gather the plurality of cells, i.e., raise the entire window covering. However, raising the whole cellular window shade can be a laborious and time consuming process.

In light of the advantages of venetian blinds and multi-cellular window shades, the ideal window treatment would provide the characteristics of both, i.e., a window treatment having excellent insulation value, adjustable light-control, modulatable view-through, and light diffusion, all together with an aesthetically pleasing presentation. Thus, a need exists for a window covering which can combine all of the these functional and aesthetic advantages into an easily and readily manufactured window covering. The structure of the present invention solves the above dilemma.

SUMMARY OF THE INVENTION

Briefly, the present invention satisfies this need and overcomes the shortcomings of the prior art through the provision of a window covering, which includes a plurality of strips arranged parallel to one another in a substantially common plane. Each of these strips is moveable in a direction parallel to a longitudinal centerline thereof. A first plurality of panels are each transversely attached to one side of one or more of the plurality of strips. When at least one of the plurality of strips is moved from a first position to a second position, each of the plurality of panels is altered from a first cross-sectional configuration to a second cross-sectional configuration. By changing the cross-sectional configuration of the panels, the window covering of the present invention can achieve adjustable light-control, modulatable view-through, light diffusion, excellent insulation value, all in an aesthetically pleasing design.

It is therefore a primary object of the present invention to enhance the art of window coverings and treatments.

It is another object of the present invention to provide a window covering having superior insulating characteristics while at the same time providing variable view-through and light control.

It is still another object of the present invention to provide a window covering which is readily and easily manufacturable.

It is another object of the present invention to provide for a highly aesthetically pleasing window covering.

BRIEF DESCRIPTION OF THE DRAWINGS

The subject matter which is regarded as the present invention is particularly pointed out and distinctly claimed in the concluding portion of the specification. The invention, however, both as to organization and method of practice, together with the further objects and advantages thereof, may be best understood by reference to the following detailed description taken in conjunction with the accompanying drawings in which:

FIG. 1 is an isometric view depicting a window covering constructed in accordance with the principles of the present invention, wherein a plurality of panels of the window covering are illustrated in nearly the fully opened (expanded) position, i.e., without view-through.

FIG. 2 is an isometric view similar to that shown in FIG. 1, except the panels of the window covering are shown in the fully closed (collapsed) position, i.e., with view-through.

DESCRIPTION

It will be readily apparent that the components of the present invention, as generally described and illustrated in the figures, could be arranged and designed in a wide variety of different configurations. Thus, the following detailed description of the presently preferred embodiments of the sheer support window covering of the present invention, as represented in FIGS. 1–6, is not intended to limit the scope of the invention, as claimed, but is merely representative of the presently preferred embodiments of the invention. The presently preferred embodiments of the invention will be best understood by reference to the drawings, where like parts are designated with like numerals.

Figure 1:
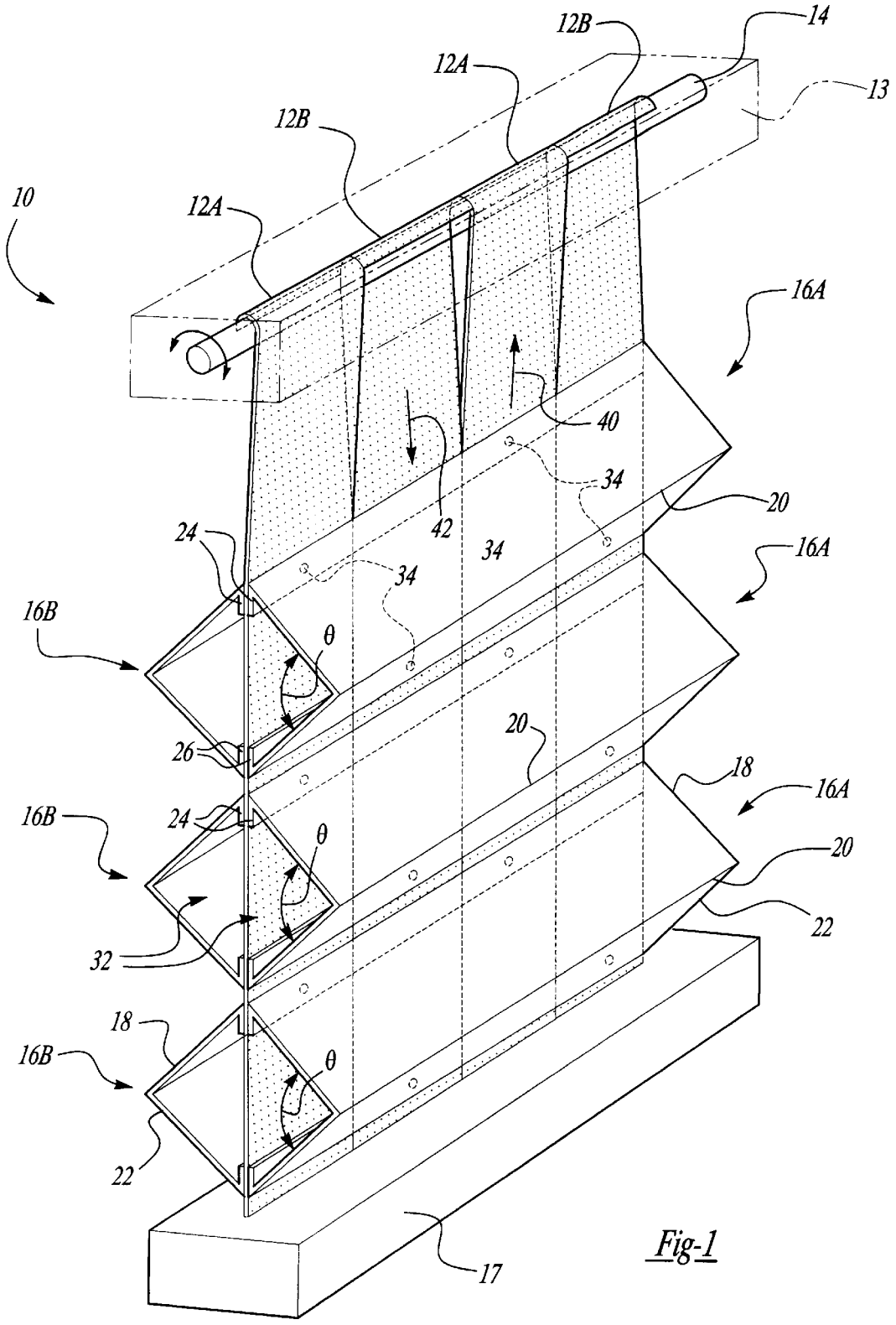

In reference to the drawings, and more particularly to FIG. 1, there is shown in accordance with the principles of the present invention, one embodiment of a window covering 10. Window covering 10 may include a plurality of vertically disposed strips 12, separated into a first set of strips 12A and a second set of strips 12B. For ease of understanding, the reference numeral "12," as used throughout this specification, will be written when referring generally to the strips of the present invention. However, reference numerals "12A" and "12B" will be written when referring to the specific sets of strips 12, i.e., either first set 12A or second set 12B. At an upper extreme, strips 12 may be attached to an actuator for altering the longitudinal position of strips 12, such as a roller 14. As will be more specifically described herein, by rotating roller 14, first set of strips 12A can be longitudinally moved in an upwardly direction 40 while second set of strips 12B can simultaneously be moved in a downwardly direction 42. At a lower extreme, strips 12 may be attached to a bottom rail 17.

A plurality of panels 16, separated into a first set of panels 16A and a second set of panels 16B may be uniquely attached to strips 12. Each panel 16 may be elongated with a border or pivot joint 20 formed thereon. For clarity of presentation and understanding, the reference numeral "16" will be written when referring generally to the panels of the present invention and the reference numerals "16A" and "16B" will be written when referring to the specific sets of panels 16A and 16B. By longitudinally moving strips 12, the shape and cross-sectional configuration of each panel 16 can be variably adjusted for effecting the view-through and light control of window covering 10.

Preferably, strips 12 are constructed from thin pieces of transparent sheer material, capable of view-through or see-through for window covering. Also, strips 12 may form a wall for improving the insulation value of window covering 12. Taken individually, each strip 12 is elongated and rectangular in shape. Any material having transparent qualities may be employed for strips 12, e.g., tape, mesh fabric, clear plastic, voile cloth ribbon, non-woven fabric of any other cloth or material having the desired transparency.

Preferably, strips 12 are aligned side-by-side so as to form a co-planar contiguous surface. Under some circumstances, it may be desirable that successive strips partially overlap one another, so as to create, for example, a moiré effect. If an overlap is desired, without the notice of the overlap area, the densities of the fabric in the overlap area may be adjusted, as is known in the art, to eliminate the notice of the overlap area.

While strips 12 are preferably transparent, so as to facilitate view-through, panels 16 are preferably constructed from a translucent material, i.e., a light diffusing material, for minimizing the transmission of light and eliminating view-through while panels 16 of window covering 10 are in the fully opened (expanded) position. Alternatively, panels 16 may be constructed from an opaque material. By adjusting the shape and configuration of panels 16, via strips 12, view-through and light transmission for window covering 10 can be variably changed.

Figure 2:
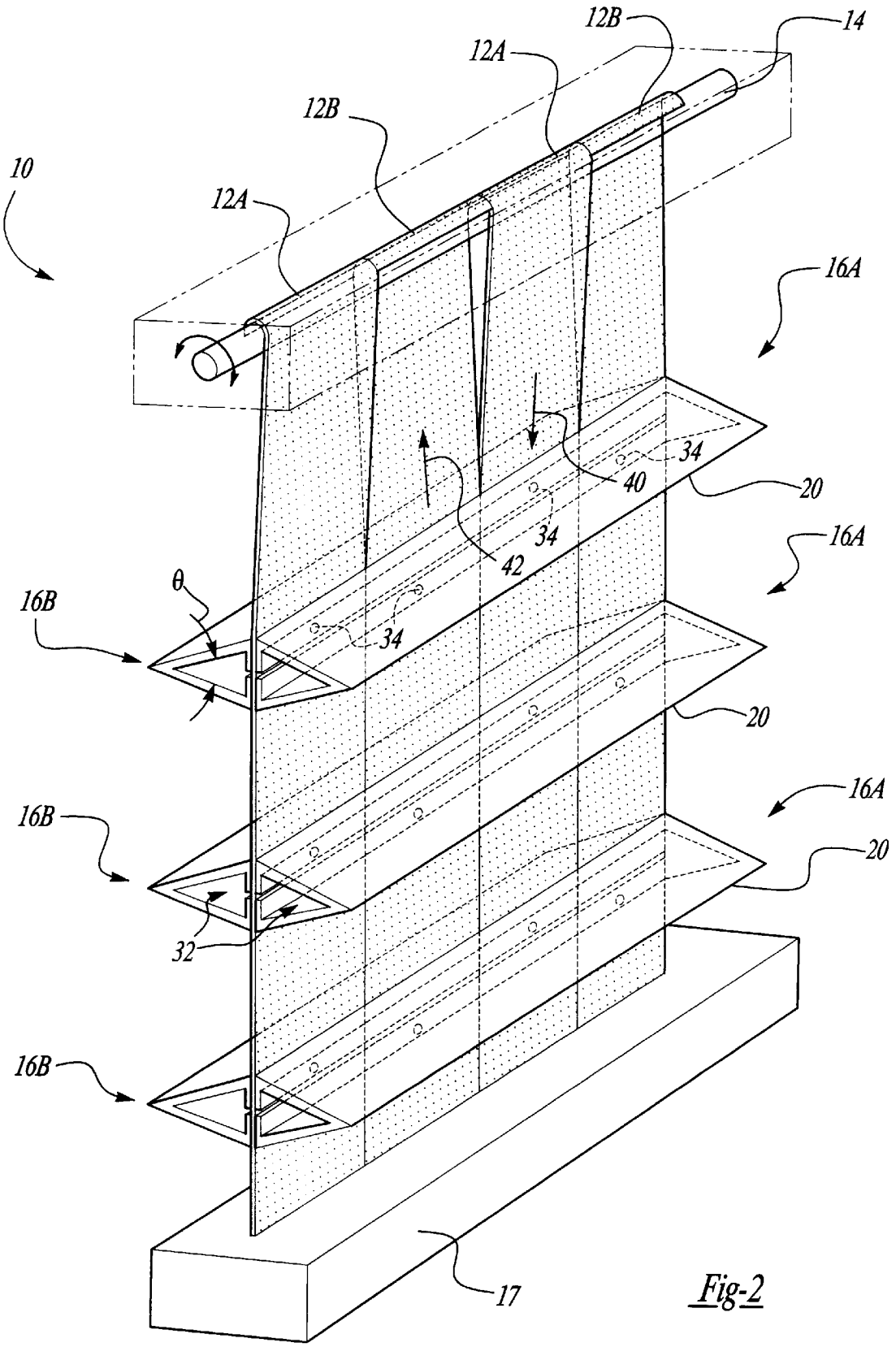

Each strip 12 includes a first side and a second side, and in the preferred embodiment, first set of panels 16A may be transversely attached to the first side and second set of panels 16B transversely attached to the second side, as illustrated in FIGS. 1–2.

In order to effect the desired cross-sectional configuration change of panels 16, the two set of strips 12A and 12B may be arranged such that successive strips alternate between a strip from first set 12A and a strip from second set 12B. Therefore, strips 12 preferably alternate between strips from set 12A and strips from set 12B. As first set of strips 12A are longitudinally moved upwardly in first direction 40, second set of strips 12B are simultaneously moved downwardly in second direction 42.

Each panel 16 may include an upper edge 24, which is affixed to first set of strips 12A, and a lower edge 26, which is affixed to second set of strips 12B. Therefore, in the preferred embodiment, upper edge 14 of each panel 16 is attached to every other strip, from set 12A, and lower edge 26 of each panel 16 is attached to every other strip, from set 12B. By affixing edges 24 and 26 in this manner, and moving first set of strips 12A and second set of strips 12B in opposing directions, the cross-sectional configuration of panels 16 can be variably modified. More specifically, as first set of strips 12A are moved in first direction 40 and second set of strips 12B are oppositely moved in second direction 42 (see FIG. 1), an angle θ for each panel 16 will become larger, and thus view-through for window covering 10 reduced. Ultimately, if angle θ is enlarged such that adjacent panels 16 touch one another, view-through can be entirely eliminated. On the other hand, as first set of strips 12A are moved in second direction 42 and second set of strips 12B are oppositely moved in first direction 40 (see FIG. 2), angle θ will become smaller, and thus view-through for window covering 10 enlarged.

As illustrated in FIG. 1, adjacent panels 16A are nearly touching, in the fully opened or expanded position, thereby limiting view-through and the transfer of light through window covering 10. Because panels 16 are preferably translucent, there is no view-through capability while the adjacent panels touch, but only the diffusion of light. In this position, panels 16 are opened or expanded. As shown in FIG. 2, adjacent panels 16A are separated from one another, thereby facilitating view-through and the transfer of light through window covering 10. In this position, panels 16 are closed or collapsed. Because strips 12 are transparent, there is nearly full view-through while window covering 10 is in the position illustrated in FIG. 2. By variably adjusting the configuration of panels 16, a multitude of different view-through positions can be achieved.

The transparency of strips 12 causes panels 16 to appear suspended in air, without any visible support. Therefore, by employing transparent strips 12, unsightly support cords can be eliminated from view, thus giving a cordless appearance, which adds significant aesthetic presentation value to window covering 10. Alternatively, strips 12, which function as control elements, could be narrower so as to leave a gap between adjacent strips, or they could be in the form of cord-like control elements. In each embodiment, however, the control elements lie in a substantially common plane and are connected to the panels at the locations described herein.

Figure 3:
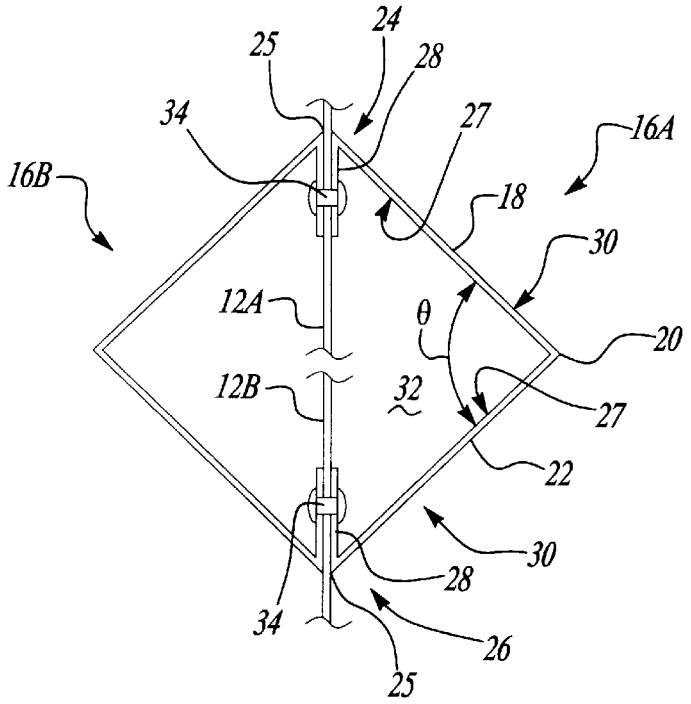
FIG. 3 is a side view of two panels of the present invention, each panel being aligned adjacent to one another and affixed to opposing sides of a centrally disposed strip.
Figure 5:
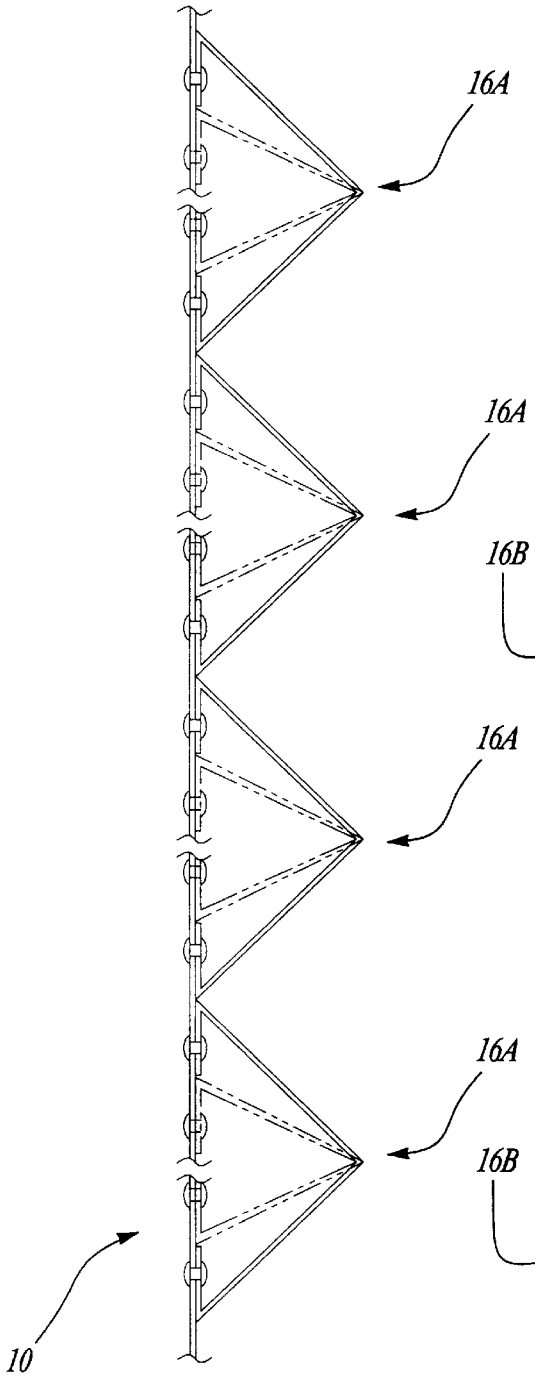
FIG. 5 is a side view showing the panels on only one side of the strips.
Figure 6:
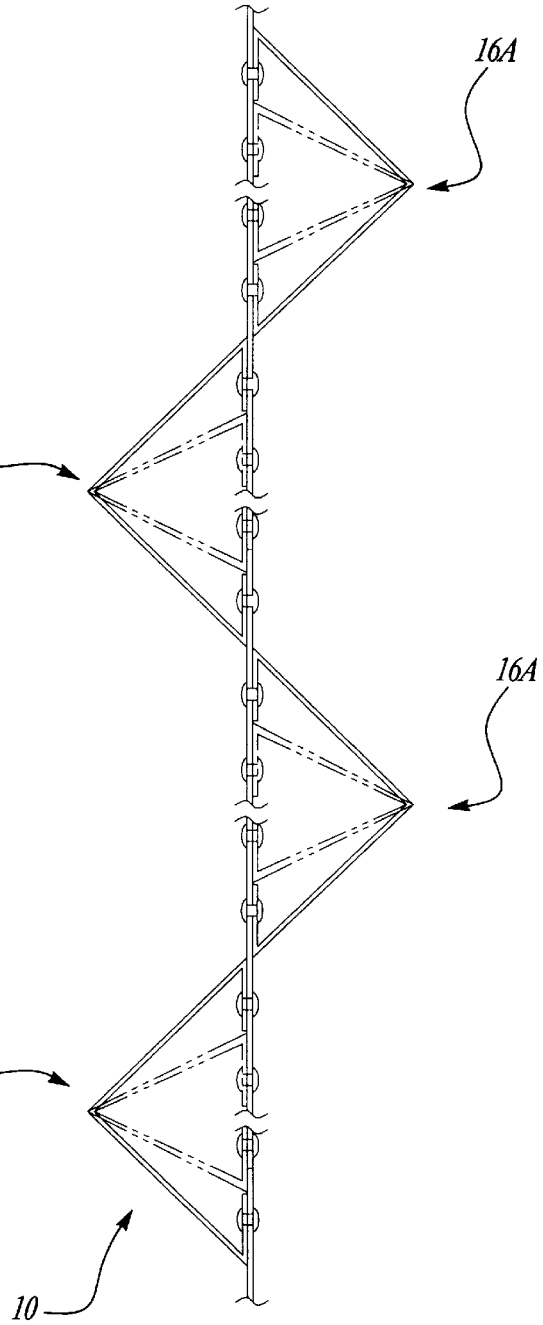
FIG. 6 is a side view illustrating the panels staggered on both sides of the strips.

As can be seen best in cross-section in FIG. 3, each panel 16A may be adjacently aligned to a corresponding panel 16B, thereby giving the impression that a corresponding pair of panels appear to be a single structure, i.e., a four sided cellular structure. While in the preferred embodiment, first and second sets of panels 16A, 16B are adjacently aligned and attached to both sides of strips 12, as shown in FIGS. 1–4, panels 16 may be alternatively secured to only one side thereof, as shown in FIG. 5. Furthermore, as shown in FIG. 6, panels 16 can be staggered on both sides of strips 12.

Preferably, panels 16 are attached to strips 12 in perpendicular relationship. However, it should be noted that there is no requirement that the strips and panels be oriented orthogonally, but only transverse to one another. In fact, under some circumstances, it may be desirable that strips 12 and panels 16 be arranged in a non-perpendicular relationship.

FIG. 3 illustrates that each panel 16 may include a first segment 18 pivotally joined to a second segment 22. Preferably, first segment 18 and second segment 22 are each formed from a rigid material, wherein a flaccid, hinge-like joint 20 is disposed therebetween. By pivoting each panel 16 about joint 20, panels 16 can be easily opened (expanded) and closed (collapsed). Both first and second segments 18, 22 may be cambered/ as is well known to the vanes of venetian blinds, thereby adding beam strength to each panel 16, and consequently, to window covering 10.

Preferably, segments 18, 22 are rigid for providing structural stiffness and strength to each panel 16. The desired rigidity for each segment 18, 22 of panel 16 can be achieved in any known manner, such as by forming the segments integrally stiff or by attaching or affixing a stiffener or rigid element thereto.

However, the rigidity of each of the segments 18, 22 should facilitate the pivotability of joint 20. In order to attain the pivotability of joint 20, a natural hinge may be formed between adjacent rigid sides. More specifically, by keeping joint 20 deformable and soft, while the surrounding segments rigid, joint 20 can be naturally formed therebetween.

In closing (collapsing) and opening (expanding) panels 16, it is essential that the ratio of the stiffness of each joint 20 to the weight of each panel 16 be selected so as to facilitate cell expandability and collapsibility. Therefore, the stiffness to weight ratio should be such that when the panels are opened, the weight of each panel must be sufficient enough so as to facilitate the expansion of the panel, and when the panels are closed, the stiffness of each panel must be low enough so as to facilitate the collapsing of the panel.

First segment 18 and second segment 22 each include an inner surface 27 and an outer surface 30. A channel 32 is defined by the inner surfaces 27 of first segment 18 and second segment 22 and the common plane upon which strips 12 extend. In cross-section, as shown in FIG. 3, channel 32 is triangular in shape, and variably adjustable angle θ is formed between inner surface 27 of first segment 18 and inner surface 27 of second segment 22. By adjusting the longitudinal position of either or both first set of strips 12A and second set of strips 12B, panels 16 can be transformed such that angle θ is variably adjustable (and thus the volume of each channel 32 changed). A significant advantage of the present invention is the ability to variably modify angle θ so that a multitude of different view-through settings can be achieved for window covering 10.

Each edge 24, 26 may include a lip 28, i.e., a narrow rigid strip, for facilitating connection to strips 12. A pivot joint 25 may separate each lip 28 from a respective segment 18, 22. Upper edge 24 and lower edge 26 are affixed to strips 12 by any known fastening means, e.g., adhesives, chemical bonds and mechanical fasteners. As shown in FIG. 3, a known double-ended barb 34 may be employed to secure corresponding panels 16A and 16B to the sides of strips 12.

Figure 4:
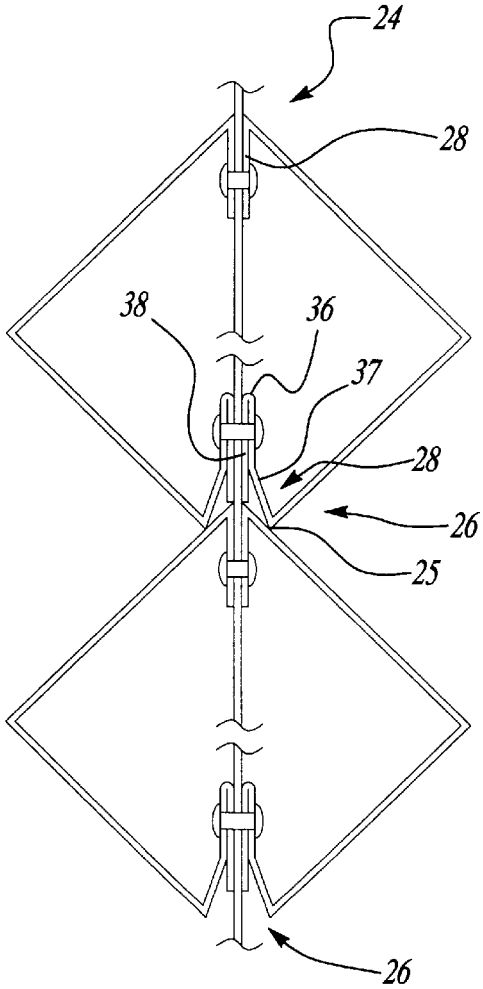
FIG. 4 is another side view of two panel sets, wherein each of the panels include a unique lower edge configuration.

In an another embodiment of the subject invention, lower edge 26 may take the form as illustrated in FIG. 4. Specifically, the lower lip 28 may be folded at a joint 36, thus dividing lower lip 28 into a first section 37 and a second section 38. This configuration facilitates the attachment of second section 38 of each panel 16 to strips 12. For example, in attaching lower edge 26 of each panel 16 to strips 12, second section 38 can be accessed from outside of each panel 16, thus facilitating the stapling of panels 16 to strips 12. Furthermore, when in the fully opened position (FIG. 4), this arrangement permits joint 25 of each panel 16A to become nestled over upper edge 24 of the adjacent touching panel 16A, thereby preventing gaps between adjacent panels and adding a desirable aesthetic impression for window covering 10.

In order to effect the longitudinal movement of the strips, the upper ends of first set of strips 12A are attached to roller 14 (FIGS. 1 & 2), extending clockwise thereabout, and the upper ends of second set of strips 12B are attached to roller 14, extending counter-clockwise thereabout. When roller 14 is rotated about its longitudinal axis, first set of strips 12A may be moved in a first direction 40 while second set of strips 12B may be simultaneously moved in an opposite direction 42. Rotation of roller 14 can be effected by any conventional means, such as by a vertically rotatable wand or control rod, a slide stick, or an electric motor. While in the preferred embodiment, roller 14 is common to both first and second sets of strips 12A, 12B, it should be noted that independent actuation means for moving the sets of strips may be employed in lieu of roller 14.

In order to gather or collectively raise window covering 10, conventional lift cords can be employed in the present invention. Thus, as is well known in the art, a plurality of cords (not shown) may extend from bottom rail 17 to a top rail 13 for raising window covering 10.

In order to achieve various different aesthetic impressions, the materials selected for the components of the present invention may be altered depending on the aesthetic impression sought. For example, the two segments 18, 22 of each panel 16 may be fabricated from materials having different colors, degrees of translucency, etc. Also, strips 12 may also be fabricated from materials having varying degrees of transparency so as to create a desired aesthetic effect for window covering 10.

In accordance with the subject invention, there are at least four primary modes of use. The first mode is where window covering 10 is in the fully raised position, with panels 16 being fully collapsed and gathered collectively at the top of window covering 10, thus providing full view-through and complete light passage through the window. The second mode is where window covering 10 is in the deployed position (lowered), with each of the panels 16 being fully collapsed so as to provide nearly full view-through (like a traditional venetian blind when the slats are arranged parallel to the plane of the ground) and significant light passage through window covering 10. In the third mode, the covering is in the deployed position, with each of panels 16 being fully opened so as to provide no view-through and the diffusion of light. The third mode presents a pleated appearance for window covering 10 and provides insulation (insulation being enhanced because of the multiple layers of material and the absence of perforations for actuation cord) and light diffusion properties known to multi-cellular window shades. There are significant insulation properties for window covering 10. The fourth mode is where window covering 10 is in the deployed position, each panel 16 being arranged somewhere between the fully opened and closed positions so as to provide controllable view-through and light transmission for window covering 10.

While several aspects of the present invention have been described and depicted herein, alternative aspects may be effected by those skilled in the art to accomplish the same objectives. For example, while the figures disclose strips being disposed vertically (and the panels disposed horizontally), it is envisioned that the orientation of the strips and panels can be rotated by 90 degrees. Moreover, while it is preferred that strips 12 alternate between strips from first set 12A and second set 12B, in lieu thereof, it may be desirable to have sets of strips arrayed other than in simple alternating order. Finally, while in the preferred embodiment, strips 12 are constructed from thin sheer materials, strips 12 alternatively may each be a narrowly formed cord, wherein an open space exists between successive cords. Accordingly, it is intended by the appended claims to cover all such alternative aspects as fall within the true spirit and scope of the invention.

What is claimed:

1. A window covering, comprising:

a plurality of elongated strips arranged parallel to one another in a substantially common plane, said strips being aligned side-by-side so as to form a substantially contiguous planar surface extending substantially across the full width of the window covering, said plurality of strips being formed of a material sufficiently transparent to permit viewing therethrough, said plurality of strips comprising a first set of strips and a second set of strips, said first and second sets of strips each including at least one strip;

each of said first set of strips being moveable in a direction parallel to a longitudinal centerline thereof, and being movable relative to said second set of strips;

a first plurality of panels each having a first portion attached to a first side of said first set of strips and a second portion attached to a first side of said second set of strips, said fist side of said first and second sets of strips coinciding with the same side of said planar surface;

wherein when said first set of strips is moved relative to said second set of strips, each of said plurality of panels is altered from a first cross-sectional configuration to a second cross-sectional configuration.

2. The window covering of claim 1, wherein the range of movement of said first set of strips relative to said second set of strips extends from a first condition, in which adjacent panels are spaced from each other to leave a view-through gap therebetween, to a second condition, in which said view-through gap is substantially eliminated.

3. The window covering of claim 1, wherein said plurality of strips are arranged such that successive strips alternate between strips from said first set and strips from said second set.

4. The window covering of claim 1, wherein said each of the panels of said first plurality of panels is located entirely on said first side of said strips, and wherein said window covering further comprises a second plurality of panels located entirely on the opposite side of said strips from said first side, said second plurality of panels each having a first portion attached to said opposite side of said first set of strips and a second portion attached to said opposite side of said second set of strips;

wherein when said first set of strips is moved relative to said second set of strips, each of said second plurality of panels is altered from a first cross-sectional configuration to a second cross-sectional configuration.

5. The window covering of claim 4, wherein each of said first plurality of panels is adjacently aligned and paired with a corresponding one of said second plurality of panels.

6. The window covering of claim 5, wherein each of said second plurality of panels has a cross sectional shape which is a mirror image of the panels of said first plurality of panels.

7. The window covering of claim 1, further comprising means for moving each of said first set and said second set of strips in a direction parallel to said longitudinal centerline, said means moving said first set in a direction opposite to the direction of movement of said second set.

8. The window covering of claim 7, wherein said means for moving is a roller rotatable about a central axis thereof, said first set of strips being attached to said roller and extending clockwise at least partially thereabout and said second set of strips being attached to said roller and extending counter-clockwise at least partially thereabout, wherein when said roller is rotated, said first set of strips are moved in said first direction while said second set of strips are moved in said opposite direction.

9. The window covering of claim 1, wherein each of said plurality of panels includes a first segment joined to a second segment at a joint, said first and second segments being pivotable about said joint.

10. The window covering of claim 9, wherein said first and second segments each include an inner surface, a channel being defined by said inner surfaces of said first and second segments and said substantially common plane, an angle being formed between said first and second surfaces, said angle being variably adjustable between a first value and a second value.

11. The window covering of claim 9, wherein a portion of each of said first segments remote from said joint is secured to said first set of strips, and a portion of each of said second segments remote from said joint is secured to said second set of strips.

12. The window covering of claim 1, wherein successive strips partially overlap one another.

13. The window covering of claim 1, further comprising means for gathering said plurality of panels in a direction parallel to said longitudinal centerline of each of said strips.

14. A window covering, comprising:

a plurality of elongated control elements arranged parallel to one another in a substantially common plane, said plurality of control elements including first and second sets of control elements, said first and second sets of control elements each including at least one element;

each of said first set of control elements being moveable in a direction parallel to a longitudinal centerline thereof, and being movable relative to said second set of control elements;

a first plurality of panels located on a first side of said common plane, each of said first plurality of panels having a first portion attached to said first set of control elements and a second portion attached to said second set of control elements;

a second plurality of panels located on the opposite side of said common plane from said first side, each of said second plurality of panels having a first portion attached to said first set of control elements and a second portion attached to said second set of control elements;

each of said first plurality of panels being adjacently aligned and paired with a corresponding one of said second plurality of panels, whereby each of said panel pairs forms a tube-like cell;

wherein when said first set of control elements is moved relative to said second set of control elements, each of said first and second plurality of panels is altered from a first cross-sectional configuration to a second cross-sectional configuration.

15. The window covering of claim 14, wherein the range of movement of said first set of control elements relative to said second set of control elements extends from a first condition, in which adjacent cells are spaced from each other to leave a view-through gap therebetween, to a second condition, in which said view-through gap is substantially eliminated.

* * * * *

UNITED STATES PATENT AND TRADEMARK OFFICE

CERTIFICATE OF CORRECTION

PATENT NO. :6,006,812
DATED :12/28/99
INVENTOR(S) :Corey, John A.

It is certified that error appears in the above-identified patent and that said Letters Patent is hereby corrected as shown below:

In column 7, in claim 1, on line 19, please change "fist" to --first--.

Signed and Sealed this

Tenth Day of April, 2001

*Attest:*

Nicholas P. Godici

NICHOLAS P. GODICI

*Attesting Officer*

*Acting Director of the United States Patent and Trademark Office*